US009670731B2

(12) United States Patent
Roberts et al.

(10) Patent No.: US 9,670,731 B2
(45) Date of Patent: Jun. 6, 2017

(54) ADJUSTABLE BENT HOUSING FOR DIRECTIONAL DRILL STRING

(71) Applicants: Paul Donald Roberts, Spring, TX (US); Timothy Edward LaGrange, Rainbow, TX (US)

(72) Inventors: Paul Donald Roberts, Spring, TX (US); Timothy Edward LaGrange, Rainbow, TX (US)

( * ) Notice: Subject to any disclaimer, the term of this patent is extended or adjusted under 35 U.S.C. 154(b) by 401 days.

(21) Appl. No.: 13/999,591

(22) Filed: Mar. 11, 2014

(65) Prior Publication Data

US 2015/0034390 A1 Feb. 5, 2015

Related U.S. Application Data

(60) Provisional application No. 61/958,514, filed on Jul. 30, 2013.

(51) Int. Cl.
*E21B 7/06* (2006.01)

(52) U.S. Cl.
CPC ..... *E21B 7/067* (2013.01)

(58) Field of Classification Search
CPC ..... E21B 7/067
See application file for complete search history.

(56) References Cited

U.S. PATENT DOCUMENTS

| | | | | | |
|---|---|---|---|---|---|
| 2,987,129 | A * | 6/1961 | Webb | E21B 31/113 | 175/297 |
| 3,884,051 | A * | 5/1975 | Bottoms | E21B 17/07 | 175/321 |
| 4,077,657 | A | 3/1978 | Trzeciak | | |
| 4,722,615 | A * | 2/1988 | Bailey | E21B 10/20 | 175/369 |
| 4,813,497 | A * | 3/1989 | Wenzel | E21B 7/067 | 166/237 |
| 5,048,621 | A * | 9/1991 | Bailey | E21B 7/067 | 175/256 |
| 5,125,463 | A | 6/1992 | Livingstone | | |
| 5,168,943 | A | 12/1992 | Falgout, Sr. | | |
| 5,248,004 | A * | 9/1993 | Witte | E21B 7/067 | 175/325.2 |
| 5,343,966 | A | 9/1994 | Wenzel | | |
| 6,516,901 | B1 * | 2/2003 | Falgout, Sr. | E21B 7/067 | 175/256 |
| 6,550,818 | B2 | 4/2003 | Robin | | |
| 6,554,083 | B1 * | 4/2003 | Kerstetter | E21B 7/067 | 175/107 |
| 8,500,176 | B2 * | 8/2013 | Marchand | E21B 7/067 | 285/330 |
| 2009/0321143 | A1 * | 12/2009 | Lyon | E21B 4/14 | 175/293 |
| 2011/0172922 | A1 | 7/2011 | Evans et al. | | |
| 2015/0300098 | A1 * | 10/2015 | Logan | E21B 47/01 | 166/237 |

* cited by examiner

*Primary Examiner* — Kipp Wallace
(74) *Attorney, Agent, or Firm* — W. Allen Marcontell

(57) ABSTRACT

An adjustable bent housing assembly for a deviated direction drill string having 1.5° adjustment increments between an index sub housing and mandrel has variances of less than 0.02° at 0.25 nominal degree increments between 0° and 3.00° of drill direction deviation.

32 Claims, 8 Drawing Sheets

| Calculated Targets | | Design Targets 1.5 deg | | | |
|---|---|---|---|---|---|
| *Rotation* | *Bend Angle* | *Rotation* | *Bend Angle* | Marking | Variance |
| 0.00 | 0.000 | **0** | **0.000** | 0.00 | 0.000 |
| 19.20 | 0.500 | **19.5** | **0.508** | 0.50 | -0.008 |
| 28.96 | 0.750 | **28.5** | **0.738** | 0.75 | 0.012 |
| 38.94 | 1.000 | **39** | **1.001** | 1.00 | -0.001 |
| 49.24 | 1.250 | **49.5** | **1.256** | 1.25 | -0.006 |
| 59.99 | 1.500 | **60** | **1.500** | 1.50 | 0.000 |
| 71.36 | 1.750 | **72** | **1.763** | 1.75 | -0.013 |
| 83.62 | 2.000 | **84** | **2.007** | 2.00 | -0.007 |
| 97.20 | 2.250 | **97.5** | **2.255** | 2.25 | -0.005 |
| 112.92 | 2.500 | **114** | **2.516** | 2.50 | -0.016 |
| 132.92 | 2.750 | **133.5** | **2.756** | 2.75 | -0.006 |
| 180.00 | 3.000 | **180** | **2.999** | 3.00 | 0.001 |

| Rotational Increment (degrees) | 1.00 | | 1.50 | | 2.00 | | 2.50 | | 3.00 | | 4.00 | |
|---|---|---|---|---|---|---|---|---|---|---|---|---|
| Nominal Deviation Angle (Bend) | Actual Deviation (Bend) | Variance | Actual Deviation (Bend) | Variance | Actual Deviation (Bend) | Variance | Actual Deviation (Bend) | Variance | Actual Deviation (Bend) | Variance | Actual Deviation (Bend) | Variance |
| degrees | degrees | degrees | degrees | degrees | degrees | degrees | degrees | degrees | degrees | degrees | degrees | degrees |
| 0.50 | 0.495 | 0.005 | 0.508 | 0.008 | 0.521 | 0.021 | 0.521 | 0.021 | 0.469 | 0.031 | 0.521 | 0.021 |
| 0.75 | 0.751 | 0.001 | 0.738 | 0.012 | 0.776 | 0.026 | 0.776 | 0.026 | 0.776 | 0.026 | 0.726 | 0.024 |
| 1.00 | 1.001 | 0.001 | 1.001 | 0.001 | 1.026 | 0.026 | 1.026 | 0.026 | 1.001 | 0.001 | 1.026 | 0.026 |
| 1.25 | 1.244 | 0.006 | 1.256 | 0.006 | 1.268 | 0.018 | 1.268 | 0.018 | 1.220 | 0.030 | 1.220 | 0.030 |
| 1.50 | 1.500 | 0.000 | 1.500 | 0.000 | 1.500 | 0.000 | 1.500 | 0.000 | 1.500 | 0.000 | 1.500 | 0.000 |
| 1.75 | 1.742 | 0.008 | 1.763 | 0.013 | 1.763 | 0.013 | 1.774 | 0.024 | 1.763 | 0.013 | 1.763 | 0.013 |
| 2.00 | 2.007 | 0.007 | 2.007 | 0.007 | 2.007 | 0.007 | 1.978 | 0.022 | 2.007 | 0.007 | 2.007 | 0.007 |
| 2.25 | 2.247 | 0.003 | 2.255 | 0.005 | 2.264 | 0.014 | 2.255 | 0.005 | 2.229 | 0.021 | 2.229 | 0.021 |
| 2.50 | 2.501 | 0.001 | 2.516 | 0.016 | 2.487 | 0.013 | 2.494 | 0.006 | 2.516 | 0.016 | 2.487 | 0.013 |
| 2.75 | 2.751 | 0.001 | 2.756 | 0.006 | 2.740 | 0.010 | 2.746 | 0.004 | 2.740 | 0.010 | 2.740 | 0.010 |
| 3.00 | 3.000 | 0.000 | 3.000 | 0.000 | 3.000 | 0.000 | 3.000 | 0.000 | 3.000 | 0.000 | 3.000 | 0.000 |

FIG. 26

ADJUSTABLE BENT HOUSING FOR DIRECTIONAL DRILL STRING

CROSS-REFERENCE TO RELATED APPLICATION

This application claims the Jul. 30, 2013 priority date benefit of Provisional Application No. 61/958,514.

BACKGROUND OF THE INVENTION

Field of the Invention

This invention relates to earthboring, in general, and directional well drilling in particular.

Description of Related Art

There are several known processes for steering the axial direction of a wellbore. The older, original, processes utilize devices such as "whipstocks" to deflect a drill string from vertical as it is rotated by surface positioned drive power. More recently, in the past 30 to 40 years, downhole drilling motors have been developed to limit rotary bit drive motion to approximately 10 feet of the bottom distal end of the drill string. Such downhole drilling motors are powered by fluid delivered along the drill string bore from surface positioned pumps. The upper length of the drill string remains rotatively static.

Among the several advantages of downhole motor drilling is the opportunity to deviate the boring direction of the drill bit along a controlled path. As a consequence, fluid mineral producers are no longer limited to the "production face" of a well corresponding to the thickness of the mineral bearing strata. With the advantage of direction controlled drilling, producers may advance the production face of a well thousands of feet along the planar lay of the strata. Hence, a greater percentage of the in situ mineral present in the strata may be produced.

In drilling processes using a downhole motor, drilling fluid is circulated under pressure through the drill string and back to the surface along the borehole annulus as in conventional drilling methods. However, the pressurized drilling fluid is directed through the power section of the downhole motor to generate power to rotate the drill bit.

In directional drilling, the path of the drill bit is deviated in a desired direction by means of a bent housing or a bent sub, typically disposed between the power section and the bearing assembly of a downhole motor. Although bent subs and bent housings may be fashioned with a fixed bend angle, it is commonly advantageous for a bent housing or bent sub to comprise an assembly of components whereby the bend angle is adjustable between being zero and some maximum bend angle.

Examples of known types of adjustable bent housings and bent subs may be seen in U.S. Pat. No. 4,077,657 to K. H. Trzeciak, U.S. Pat. No. 4,813,497 to K. H. Wenzel, U.S. Pat. No. 5,125,463 to R. S. S. Livingstone et al, U.S. Pat. No. 5,168,943 to T. E. Falgout, Sr., U.S. Pat. No. 5,343,966 to K. H. Wenzel et al and U.S. Pat. No. 6,550,818 to L. E. Robin

SUMMARY OF THE INVENTION

A deviated direction drill string includes a bent housing assembly disposed between a down hole drill motor and a drill bit.

The bent housing assembly includes an index sub, an assembly mandrel, an adjusting ring and a compression sub. The index sub comprises a pipe section preferably having a pin thread joint at one end and a box thread joint at the other.

The pin threads are turned concentrically about the traditional cylinder axis of the sub. The box threads, however, are turned about an axis that is about 1.5° skewed from the traditional axis. The annular end face of the box thread end is perpendicular to the skewed axis. One radial half of the skewed end face annulus is serrated with a tooth spacing of 1.5°.

The assembly mandrel is a short cylinder section having pin threads at opposite ends separated by a short channeled section. Axes for the pin thread ends are skewed to each other, preferably, at about 1.5°. One of the mandrel pin threads is formed to mesh with the box threads of the index sub. The other mandrel pin thread meshes with box threads in the compression sub. A linkage mechanism including several shear bearing channels in the outer surface of the mandrel mid-section are parallel with the mandrel thread axis that meshes with the box thread axis of the index sub.

The adjusting ring comprises an axially short cylinder having an internal diameter greater than the mandrel thread crest diameter. The internal cylinder surface is channeled with longitudinal grooves corresponding with the mandrel grooves. Grooves of the ring and mandrel are radially matched to receive balls or dowel pins bridging opposite grooves. When assembled, the groove and ball mechanism secures the mandrel and adjusting ring rotationally while allowing limited axial displacement. One end-face annulus of the adjusting ring is canted 1.5° to the ring surface axis. Radially, approximately half of the canted end face annulus is serrated with an approximately 1.5° tooth spacing to mesh with the serrated teeth of the index sub end face.

The compression sub has a box threaded end that meshes with the corresponding mandrel pin thread. The annular end face of the compression sub surrounding the box threads contiguously engages the other end face of the adjusting ring.

An index device such as a pin is set at a reference position in one of the two, contiguously joined annular end faces including serrated teeth. A first corresponding pin socket is drilled into the other end face. A second pin socket is drilled into the said other end face at 180° circumference degrees from the first pin socket. One of the pin sockets corresponds with an index sub housing assembly deviation setting of 0° and the other socket corresponds to a deviation setting of 3°. Additional pin sockets are drilled into the other annular face to receive the index pin at positions corresponding to aligned indicia positions.

An indicia scale on the contiguous outer surfaces of the index sub and adjusting ring has multiple setting points at selected increments between 0° and 3°. The scales progress in opposite directions from the 0° reference setting over a 90° arc to the 3° maximum deviation setting.

With the compression sub turned away from the adjacent face of the adjusting ring, the ring is drawn axially on the groove confined balls away from the index sub annulus face sufficiently to disengage the index pin and serrated teeth. The mandrel and ring are rotated together as a unit on the index sub box threads until the desired string deviation indicia are aligned. The ring is again displaced axially to engage the index pin in the socket corresponding with the desired deviation setting. Simultaneously, the serration teeth of both components are meshed to temporarily secure the setting. A final security setting is obtained by returning the compression sub to contiguous engagement with the adjusting ring.

The present 1.5° setting increments between the index sub and adjusting ring allows drill string deviation angles in 0.25° nominal increments at less than 0.02° variation between a nominal deviation angle setting and the actual angle obtained.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

FIG. 26 is a tabulation of angle variations from nominal tool setting values respective to a spectrum of tool rotational increment values.

DESCRIPTION OF THE PREFERRED EMBODIMENTS

As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
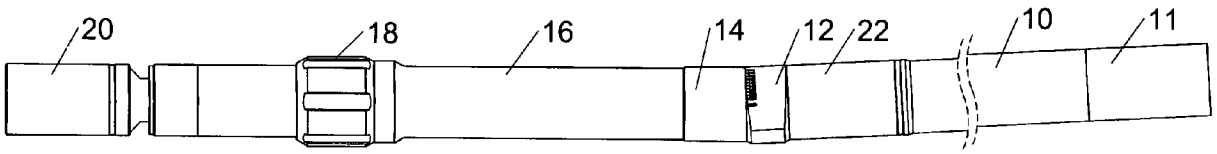
FIG. 1 is an elevation view of the lower end of directional drill string assembly.

For descriptive orientation, reference is given to FIG. 1 which shows the lower distal end of a deviated direction drill string. A drilling fluid powered drill motor 10 is disposed below the drill collars 11. The drill collars provide the end-biased weight upon the cutting bit at the distal end of the drill string. Traditionally, a drill collar is a 30' (approximately) length of pipe having an exceptionally thick wall annulus. Numerous such pipe lengths may be connected in series to achieve the desired bit weight. Theoretically, that portion of the drill string above the collars 11 is under tensile stress.

Below the drill motor 10 is a compression sub 22 that independently bears upon the angle adjusting ring 12 portion of the bent housing assembly 15. The adjusting ring 12 is secured compressively between the lower end-face of the compression sub 22 and the upper end-face of the index sub 14. The lower end-face of the index sub 14 bears against the lower drive shaft housing 16 which usually includes a wear collar sub 18. A bit sub 20 is secured to the lower distal end of a drive shaft that is rotatably driven within the housing 16 by the drill motor 10. A drill bit, not shown, is secured to the lower distal end of the bit sub 20.

The term "sub", as used herein, is a drilling industry term of art for describing an incremental segment of a drill string usually having a length less than a full pipe joint and formed or constructed to perform a specific task in the drilling or well completion process.

Figure 2:
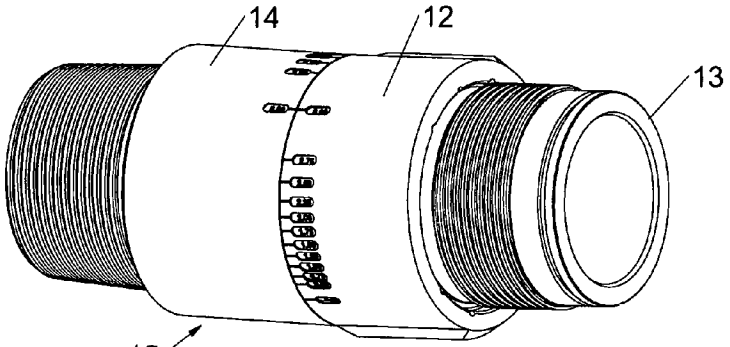
FIG. 2 is a perspective view of the present adjustable bent housing assembly.
Figure 3:
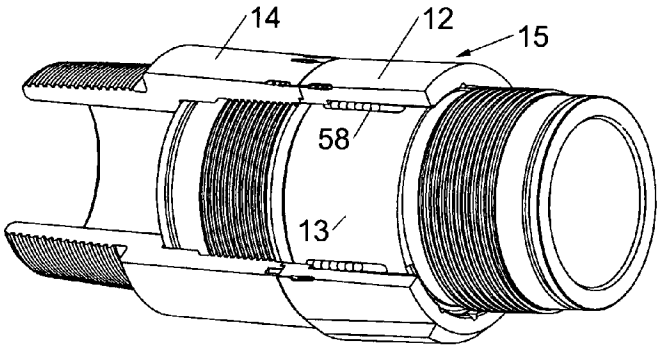
FIG. 3 is a partially sectioned perspective view of the present adjustable bent housing assembly.

The adjustable bent housing assembly 15 is shown by FIG. 2 and in isolated perspective by FIG. 3 to include a mandrel 13 for structurally integrating the drill motor 10 with the index sub 14. In the section perspective of FIG. 3, the mandrel 13 is shown as the structurally combining link between the adjusting ring 12 and index sub 14.

Figure 6:
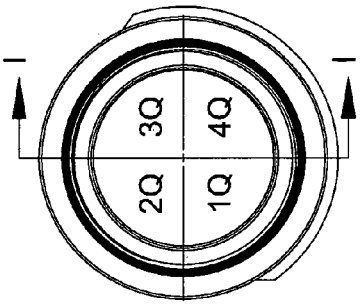
FIG. 6 is an end view of the bent housing set for 0° deviation.
Figure 4:
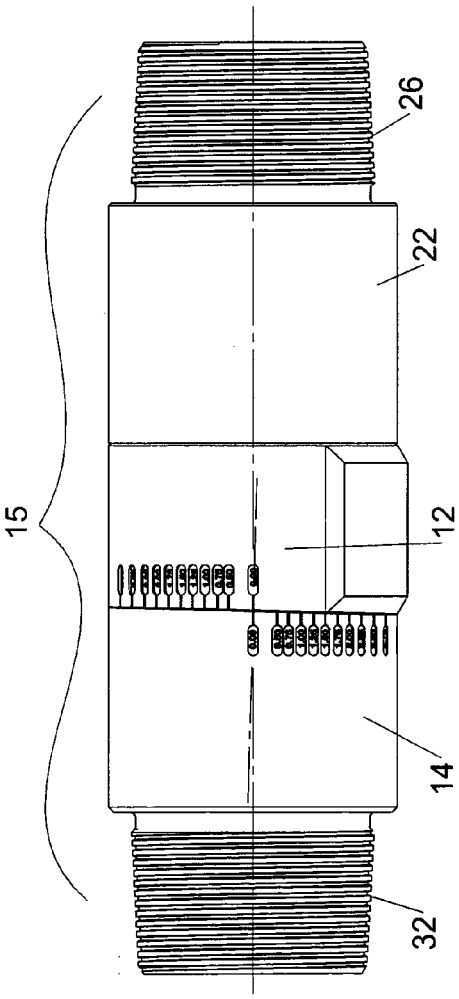
FIG. 4 is an elevation view of the present adjustable bent housing assembly set for 0° deviation.
Figure 5:
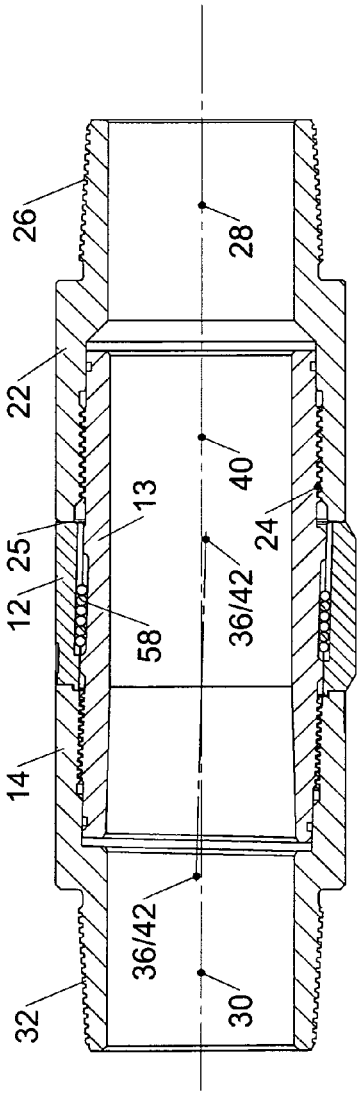
FIG. 5 is an axial section view of the present adjustable bent housing assembly set for 0° deviation as viewed along cutting plane I-I of FIG. 6.

Referring further to the orthographic side elevation of FIG. 4, end elevation of FIG. 6 and axial length section of FIG. 5, the assembly 15 is further shown to include a compression sub 22 having a box thread end 24 and a pin thread end 26. Typically, the form and pitch of these threads 24 and 26 is not necessarily the same. The pin threads 26 mesh with corresponding box threads in the motor sub 10. The compression sub 22 and thread sets 24 and 26 are turned concentrically about a primary axis 28. Similarly, the annular end-face 25 of the compression sub is normal to the primary axis 28.

Figure 7:
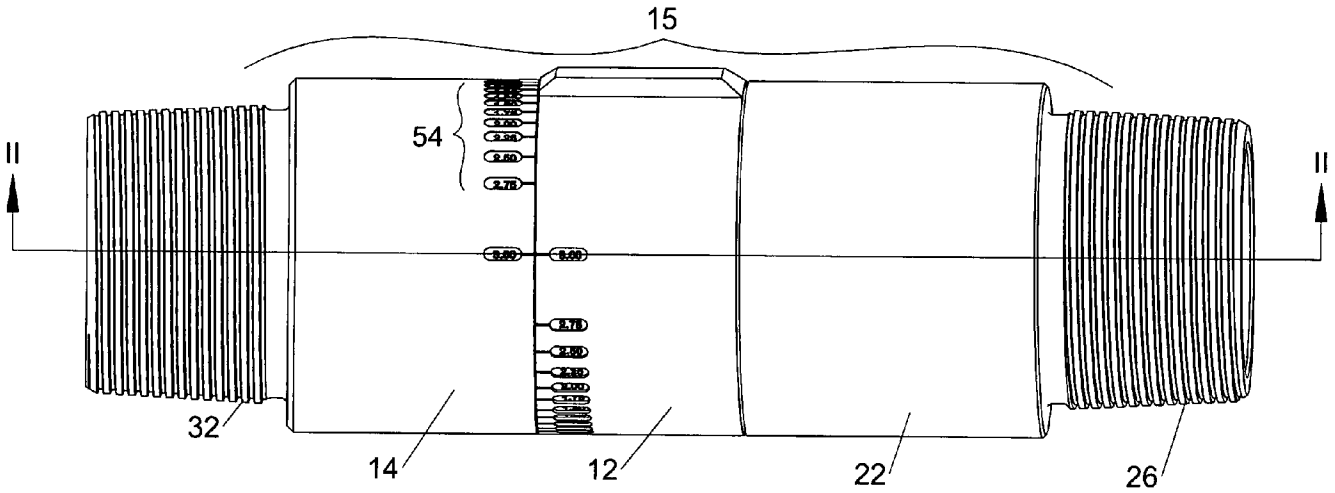
FIG. 7 is an elevation view of the bent housing set for 3° deviation.
Figure 8:
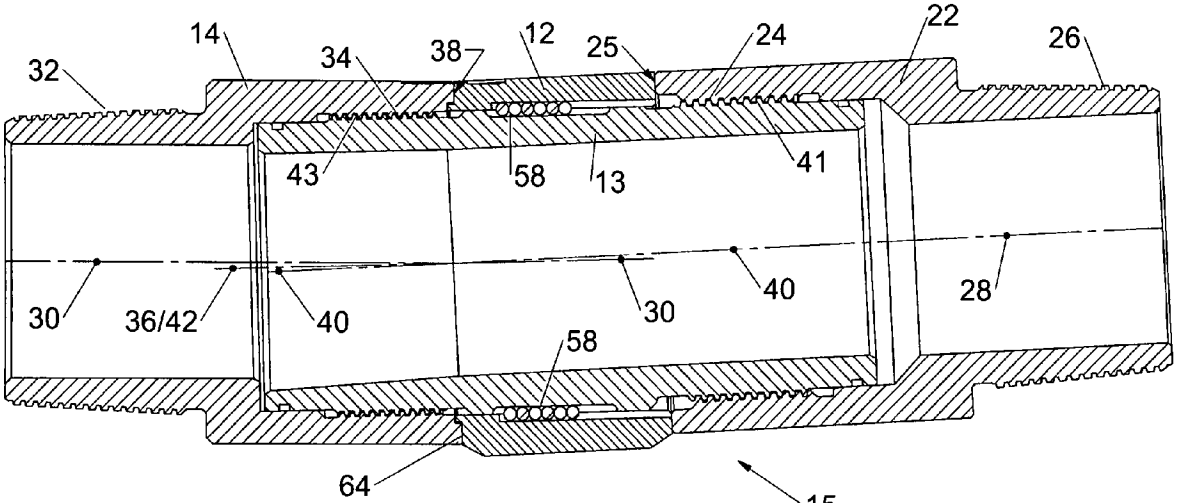
FIG. 8 is an axial section view of the bent housing set for 3° deviation as viewed along cutting plane II-II of FIG. 7.
Figure 11:
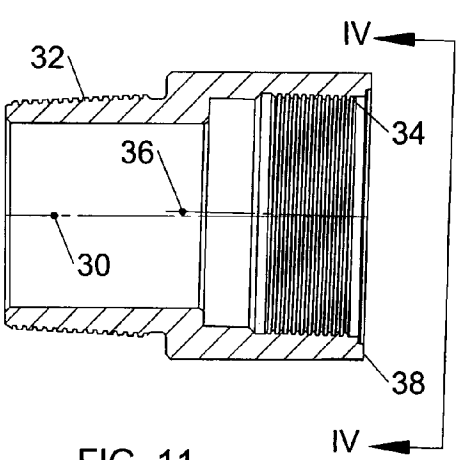
FIG. 11 is an axial section view of the index sub.
Figure 10:
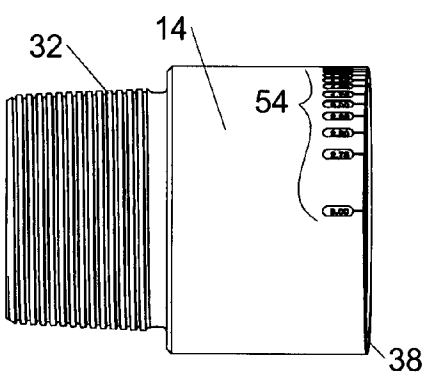
FIG. 10 is an elevation view of the index sub.

As shown by FIGS. 7 and 8, the external cylindrical surface of the index sub 14 and pin threads 32 are turned concentrically about a secondary axis 30 which continues along the lower drive shaft housing 16 and bit sub 20. Distinctively, however, index sub box threads 34 are turned about a lower bent axis 36 which departs angularly from an intersection with the secondary axis by an included angle value that is half of the desired maximum deviation angle; e.g. 1.5° for a maximum deviation angle of 3°. Correspondingly, the annular end-face 38 of the index sub 14 is formed normal to the lower bent axis 36 and is therefore skewed to the external cylindrical surface of the index sub 14.

Figure 20:
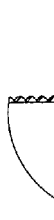
FIG. 20 is an enlarged detail of the region B of FIG. 17.
Figure 19:
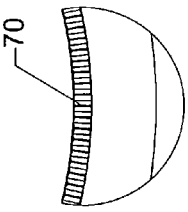
FIG. 19 is an enlarged detail of the region A of FIG. 16.

Further characteristics of the index sub end-face 38 as shown by FIGS. 9-12 include a serrated radial half 50 of the end-face annulus 38. Preferably, the serrated ridges are radially aligned around the inner circumference of the end-face in approximately 1.5° increments as illustrated by FIGS. 19 and 20.

Figure 9:
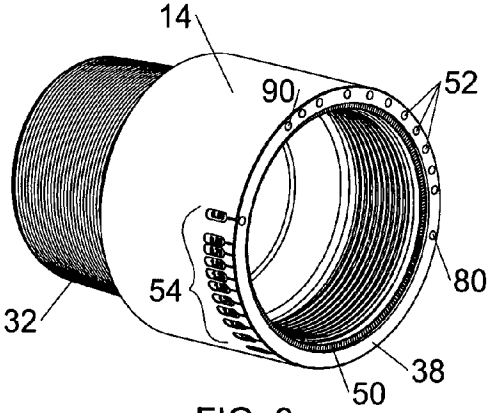
FIG. 9 is a perspective view of the index sub.
Figure 12:
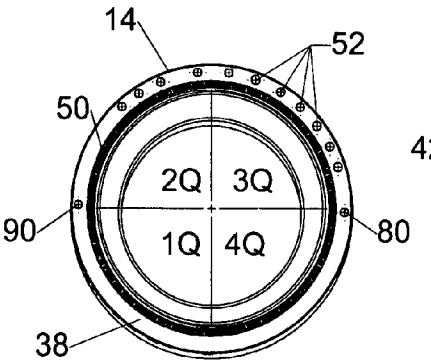
FIG. 12 is an end elevation view of the index sub as viewed along plane IV-IV of FIG. 11.

FIGS. 9 and 12 also show a plurality of index sockets 52 blind drilled into the outer half of the end-face annulus 38 along the second and third azimuth quadrants 2Q and 3Q, respectively. The arcuate distribution of these index sockets is related to the provision of a desired set of bit deviation angles in a manner to be subsequently explained.

Distributed over the first quadrant azimuth 1Q of the index sub outer surface are a number of alignment indicia 54 stenciled into the sub surface by which rotational adjustment of the tool is referenced to set the desired deviation angle. The position of individual indicators 54 is related to the arcuate position of the sockets 52 as will be subsequently explained.

Figure 14:
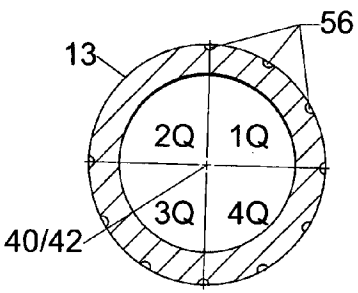
FIG. 14 is a cross section view of the mandrel along cutting plane III-III of FIG. 13.
Figure 13:
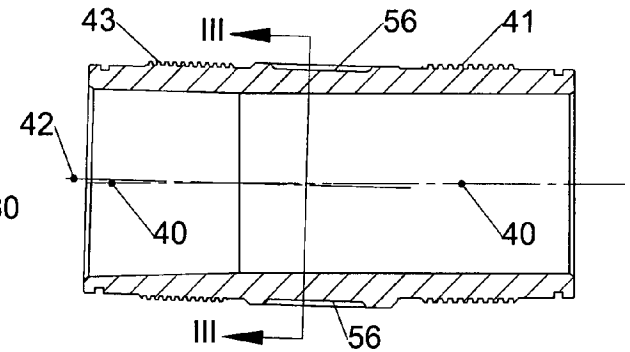
FIG. 13 is an axial section view of the mandrel.

Respectively opposite ends of the mandrel 13 as shown by FIGS. 13 and 14 are formed concentrically about separate but intersecting axes. Lower pin threads 43 are turned about the lower mandrel axis 42. Upper pin threads 41 are turned about the upper mandrel axis 40. Since the upper mandrel threads 41 are formed to mesh with the box threads 24 of the compression sub 22, it necessarily follows that the upper mandrel axis 40 is coincident with the drill string primary axis 28. This relationship is shown by FIGS. 4 and 5. Similarly, the lower mandrel pin threads 43 are formed to mesh with the index sub box threads 34. Consequently, the lower mandrel axis 42 is coincident with the index sub box thread axis 36.

Since the index sub box thread axis 36 departs from the secondary axis 30 by a first angle and the upper mandrel axis 40 departs from the lower mandrel axis 42 by a second angle that is equal to the first angle, it will be understood that as the mandrel 13 is rotated within the box sub threads 34 about the lower bent axis 36, the upper mandrel axis 40 will trace a conical path in which one conical surface element will align in coincidence with both, the primary axis 28 and the secondary axis 30. 180° around the cone base circle, however, the upper mandrel axis 40 will depart from the secondary axis 30 by a value equal to the sum of the first and second angles. Should both first and second departure angles each be 1.5°, mandrel 13 may be rotated about the index sub box threads 34 to a position at which the upper mandrel axis 40 is coincident with both, the primary axis 28 and the secondary axis 30. In this alignment, the deviation angle of the drill bit is 0°. A 0° deviation alignment is normally considered the reference position. 180° of mandrel rotation from the reference position will bring the axes 28/40 to a position at which the primary axis 28 departs from secondary axis 30 by the maximum 3° deviation angle. Further rotation of the mandrel reverses the deviation angle progression back to 0°.

Between the mandrel pin threads 41 and 43 is an adjusting ring linking mechanism such as a plurality of slots 56 shown by FIGS. 13 and 14. These arcuate slots 56 are cut parallel with the upper axis 40 into the outer perimeter of the mandrel along quadrant sections 1Q, 2Q and 3Q parallel with the upper axis 40. These slots will receive an arcuate portion of ball bearings 58 or rods (see FIGS. 5 and 8) in cooperation with corresponding slots in the adjusting ring 12 to prevent relative rotation between the two and simultaneously allow a limited degree of longitudinal sleeve displacement relative to the mandrel. Resultantly, the mandrel 13 and adjusting ring 12 turn on the index sub box threads 34 as a single unit about the index sub axis 36.

Referring to FIGS. 15-20, the adjusting ring 12 is seen to be, nominally, annular shaped. The circular inside diameter surface 60 is provided a sliding fit over the mandrel surface between the threads 41 and 43. See FIGS. 5 and 8. Accordingly, the centroid axis 40 corresponds to the upper mandrel axis 40. The upper end-face annulus 62 is normal to the axis 40 for a flush fit engagement with the end-face annulus 25 of compression sub 22. The lower end-face annulus 64, however, is normal to the skewed axis 65. Compatible with the mandrel linkage mechanism, bearing or rod slots 66 are cut into the ring inside surface 60 at select positions about quadrants 1Q, 3Q, and 4Q corresponding to the slots 56 in the mandrel. The adjusting ring slots 66 are open to the end-face 62 but closed at the opposite end 67 proximate of the skewed end-face 64. Preferably, the ring is supplemented with a wear boss 68 comprising a radially enhanced thickness of cylindrical wall thickness distributed over approximately 180° of the ring surface.

Figure 17:
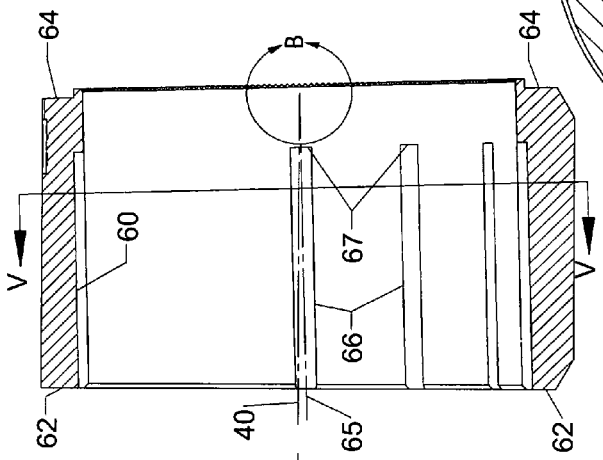
FIG. 17 is an axial section view of the adjusting ring along the cutting plane VI-VI of FIG. 16.
Figure 18:
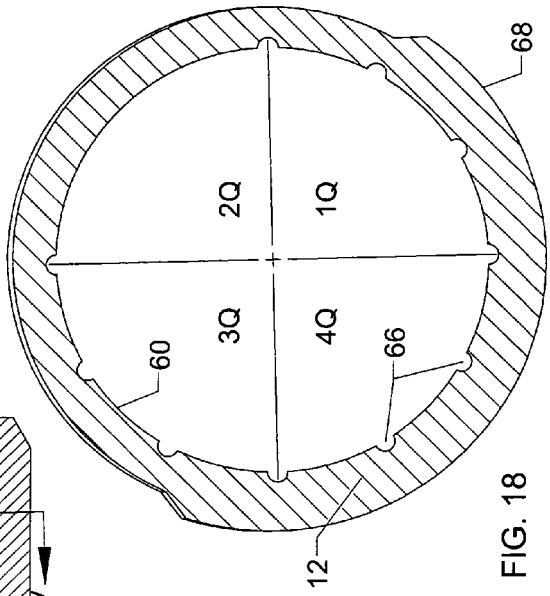
FIG. 18 is a cross section view of the adjusting ring along cutting plane V-V of FIG. 17.
Figure 16:
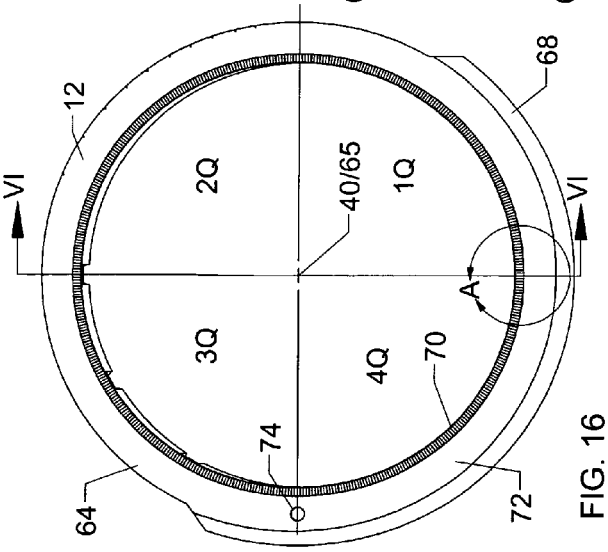
FIG. 16 is a downhole end elevation of the adjusting ring.

The annular end-face 64 of adjusting ring 12 is constructed to cooperate with the annular end-face 38 of the index sub 14. An inside annulus area 70 is serrated as shown by FIGS. 16 and 17 with a spacing of ridges 71 corresponding to the ridge spacing of serrated annulus 50 of the index sub 14. For example, 1.5° of arc between serration ridge apices. In the radially outer half 72 of the end-face annulus 64, an indexing dowel pin 74 is positioned at the approximate 270° azimuth location, for example.

Figure 15:
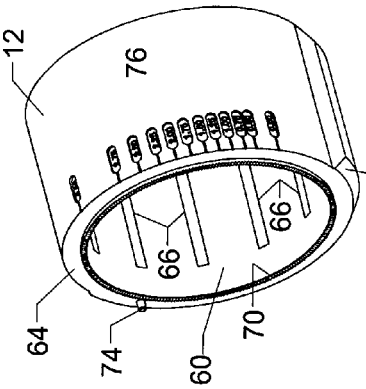
FIG. 15 is a perspective view of the adjusting ring.

As shown by FIG. 15, deviation angle indicia 76 are stenciled into the outer surface of the ring 12 adjacent the lower end-face edge 64. Similar to the index sub 14 indicia 54, the adjusting ring indicia, however, are selectively distributed over the second azimuth quadrant of the end-face at positions corresponding to the indicated bit deviation angle.

At this point, it will be useful to define the quadrant sections of the three tubular elements 12, 13, and 14 that are in substantial coaxial assembly. From a rotational reference alignment of 0° deviation whereat the mandrel upper axis 40 is coaxial with the primary axis 28 and secondary axis 30 as best illustrated by FIG. 5, there is no angular deviation in the unit between the drill motor 10 and the drill bit. Unless specifically noted, further references to the four quadrants of the assembly 15 elements 12, 13, and 14 will presume the elements to be operatively assembled with a 0° deviation angle and quadrant volumes running axially through all three elements. As the assembly is adjusted to increase the deviation angle from 0° to 3°, the quadrants 1Q and 4Q of the mandrel 13 and adjusting ring 12 are rotated to progressively align with quadrants 3Q and 2Q, respectively, of the index sub 14.

With the compression sub 22 withdrawn from the adjusting ring 12, the ring has the limited freedom to be axially withdrawn from the serrated face 38 of the index sub 14. However, due to shear bearings 58 and the slots 56 and 66, the ring 12 remains rotatively secured to the mandrel 13. If the tooth spacing of serrated annuli 50 and 70 is 1.50°, rotation of the mandrel 13 and adjusting ring 12 relative to the index sub 14 is restricted to 240 increments. However, deviation angles are duplicated for each 180° of semi-rotation. Hence, there are only 120 increments of deviation adjustment from 0° deviation to a full 3° of deviation.

As an operational practicality on a working rig floor, a driller only wants to know, with confidence, where to rotate the adjusting ring 12 relative to the index sub 14 to achieve a predetermined deviation angle to the drill string among one of several available options between 0° to 3.00° in 0.25° increments, for example. The geometric realities are that not all of the desired deviation angles coincide with one of the 120 meshed tooth positions. Some accommodation for deviation angle variance, must be tolerated. Empirically, it has been determined that a ±0.02° variance of true deviation angle from a nominally desired bend angle is tolerable. The FIG. 25 data tabulation illustrates the deviation angle variance from true deviation values and tool rotation angles for a spectrum of nominal value settings of from 0° to 3.00°. From the FIG. 25 data, it is seen that the maximum variance from the true value of a nominal 2.50° setting is 0.016°. A relative rotation of 114° between the adjusting ring 12 and the index sub 14 from a 0° deviation angle reference position produces an actual deviation angle of 2.516°. These relationships may be mathematically expressed by the $4^{th}$ order equation:

$$Y=5\times10^{-10}X^4-4\times10^{-7}X^3+4\times10^{-6}X^2+0.0261X$$

Figures 23, 24, 25:
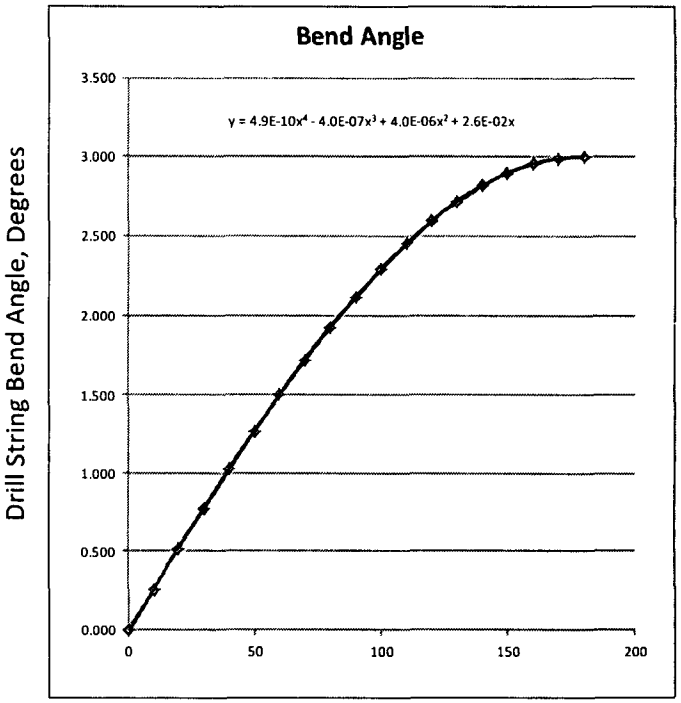
FIG. 23 is a tabulated correlation between increments of relative rotation of the mandrel within the index sub and corresponding actual bend angles.
FIG. 24 is a tabulation of variances between nominal tool settings and actual settings for 1.5° setting increments.
FIG. 25 is a graphic representation of the FIG. 23 data.

The forgoing mathematical expression is presented graphically by FIG. 25.

The data tabulation of FIG. 26 also provides an expanded comparison of variances from nominal angle settings for a spectrum of adjustment ring rotation increments from 1° to 4°. Mathematical expressions for curves fitting the locus of deviation angle progression corresponding to maximum angles of 2°, 3° and 4°, respectively, are as follows:

1) The Bend Angle varies from 0 to 2 degrees for this equation:

$$Y=3.3\times10^{-10}X^4-2.7\times10^{-7}X^3+2.8\times10^{-6}X^2+0.017X$$

2) The Bend Angle varies from 0 to 3 degrees for this equation:

$$Y=4.9\times10^{-10}X^4-4.0\times10^{-7}X^3+4.0\times10^{-6}X^2+0.026X$$

3) The Bend Angle varies from 0 to 4 degrees for this equation:

$$Y=6.5\times10^{-10}X^4-5.4\times10^{-7}X^3+5.4\times10^{-6}X^2+0.035X$$

Where; Y=Bend Angle of the Adjustable Bent Housing assembly.

Where X=Angular Displacement of Adjusting Ring/Mandrel to the Index Sub.

From the foregoing analysis, it will be understood that the relative rotational angle of a meshed assembly among serrated teeth 70 on the adjusting ring 13 with the serrated teeth 50 in the index sub 14 determines the deviation angle of the bit from the upper drill string axis 28. The adjusting ring 12, which is rotatively secured to the mandrel 13, includes annular end-face serrations 70 that mesh with a complementary annulus of face serrations 50 in the index sub 14. These annular face serrations may be meshed to secure a relative rotation position between the index sub 14 and mandrel 13.

For a 1.50° tooth separation in the serrations 50 and 70, there are 240 possible mesh positions of the serrated faces in a full circle rotation of the mandrel 13 within the index sub 14. However, only those positions most closely corresponding to a limited number of predetermined nominal deviation angles are, in fact, used: and that limited number is distributed over only half of the rotational circle.

For assistance to the driller in aligning the mandrel 13 within the index sub 14 while possibly experiencing a hostile environment on a drilling rig floor, the invention relies upon a first a first positive alignment device which includes an index pin 74 on the adjusting ring 12 placed at the 180° azimuth position between the third and fourth quadrants, 3Q and 4Q, as shown by FIG. 16. The outer annular end face 38 of the index sub 14, as shown by FIG. 12 includes a plurality of socket apertures 52 distributed at predetermined positions between a first socket 80 at the 180° azimuth position between the third and fourth quadrants, 3Q and 4Q and a last socket 90 at the 0° position between the first and second quadrants, 1Q and 2Q.

When the adjusting ring index pin 74 is engaged with first index sub socket 80, the deviation angle between the primary axis 28 and secondary axis 30 is 0°. This is the first of two common plane positions at which all axes are in common plane alignment. When the index pin 74 is engaged with the last socket 90, the deviation angle is 3.00°. This is the second of the two common plane alignment positions. Between the first and last sockets, 80 and 90, sockets 52 are positioned angularly about the end face annulus in a counterclockwise direction from the reference socket 80, at points most proximate of that required to provide the desired intermediate deviation angle. In reference to the data tabulation of FIG. 24 and the illustration of FIG. 9, it is seen that a rotation of the ring 12 and mandrel 13 over the threads 34 of the index sub 14 to transpose the index pin 74 60° from the reference socket 80 produces a deviation angle of 1.50°. A socket 52 is provided in the annular face 38 at the 60° azimuth position to receive an insert of index pin 74.

As a second example from FIG. 24, a rotation of the mandrel and adjusting ring unit to transpose the index pin 74 114° from the reference position 80 will result in and actual deviation angle of 2.516°. For communication simplicity, however, this 2.516° deviation is signified on the indicia scales 54 and 76 by the nominal value of 2.50°.

Figure 21:
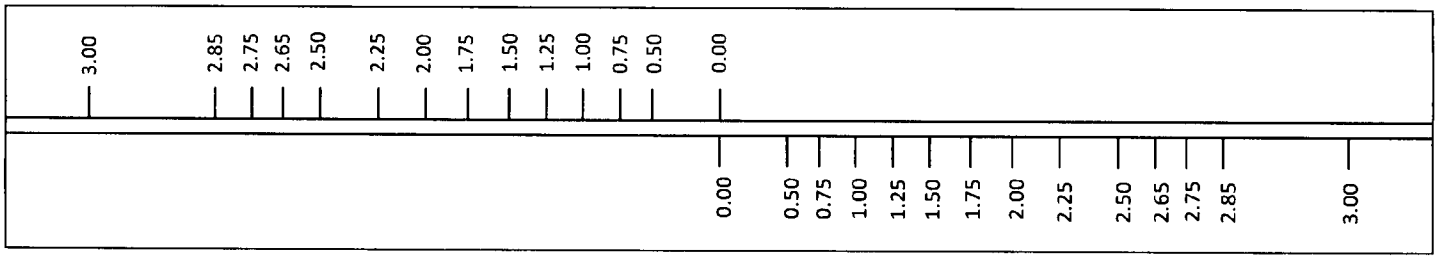
FIG. 21 is a planar development of the deviation indicia segment of the index sub and adjusting ring set for 0° deviation.

The indicia scales 54 and 76 each span 90° of the ring 12 and index sub 14 surface perimeters at the respective adjacent end faces 64 and 38. The scale values are in degrees of deviation angle and progress from 0° to the maximum, for example, 3°, in nominal degree increments. FIG. 21 illustrates this plan as a planar development with the bent sub deviation angle set at the reference position of 0°. The indicia scale reference position may be placed at any convenient point around the index sub and adjusting ring perimeters. Wherever placed, however, the reference position of the scales must correspond with the reference position of pin 74 as engaged with socket 80.

Figure 22:
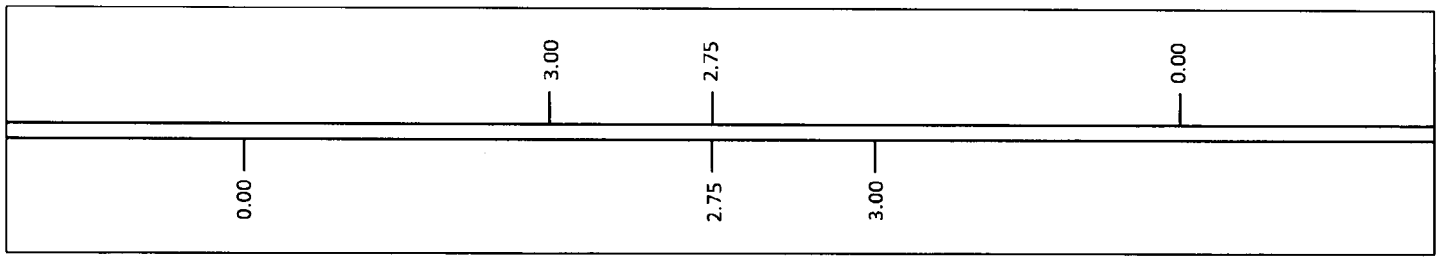
FIG. 22 Is a planar development of the deviation indicia segment of the index sub and adjusting ring set for a 2.75° deviation.

Although the scales 54 and 76 are identical, the respective deviation angle values progress in opposite arc directions from the reference position. Accordingly, each of the indicated deviation values is located at an arcuate position that, from the reference position, is half of the angular rotation required of the pin 74 about axis 40/65. For example, by reference to FIG. 22, a 2.75° deviation angle is obtained by rotating the ring/mandrel unit 133.5° relative to the index sub to align the 2.75° indicia on the ring 12 with the 2.75 indicia on the index sub 14. A socket 52 in the index sub annular face is correspondingly positioned to receive the index pin 74. The 2.75° indicia on the index sub indicia spectrum 54 is off-set 66.75° from the 0° reference position. Similarly, the 2.75° deviation indicia on the adjusting ring indicia spectrum 76 is off-set 66.75° from the 0° reference position.

The two relative alignment systems described herein are complimentary in that one provides a convenient visual finding for a desired deviation angle whereas the other exclusively verifies the desired setting. Both systems have the functional objective of positively holding the mating components at the desired setting in a vibratory hostile operating environment. Those of skill in the art will understand that the index pin 74 is not intended to carry working load. Operational shear loads at the interface between the annular end-face 38 and the end-face 64 of adjusting ring 12 are carried by the serrations 50 and 70. Those of skill in the art will also understand that the terms "serrations" or "serrated", as used herein, are used generically to include regular undulations that may be, for example, sinusoidal, pyramidal, involuted, cogged, toothed or spiked.

A threaded compression between the compression sub 22 and the lower index sub 14 provides the dominant force for securing the assembly of the index sub 14 with the mandrel/adjustment ring unit under working load. Accordingly, a deviation angle setting procedure will usually require a withdrawal of the compression sub 22 from the adjusting ring 12 by a sufficient lead to extract the pin 74 from a socket 52 and the meshed engagement of the serration teeth 50 and 70. With the compression sub annulus face 25 turned away from the annulus face 62 of the ring 12, the ring 12 may be displaced axially to disengage the pin 70 and serrated teeth.

With a pin/teeth disengagement, the ring/mandrel unit may be freely turned to align the desired indicia angle units 54/76. The channels 56/66 and bearings 58 maintain the angular relationship between the ring 12 and mandrel 13. When the desired deviation angle indicia correspondence is aligned, the pin 70 and serration teeth 50/70 are re-engaged. Compression sub 22 is turned tightly against the ring face 62 to secure the assembly setting.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modification of the invention are contemplated which may be made without departing from the spirit of the claimed invention.

The invention claimed is:

1. A directional drilling assembly comprising:

an index sub (14) having first pin threads (32) about a secondary axis (30) at one end and first box threads (34) turned about a bent axis (36) at an opposite end, said bent axis (36) intersecting said secondary axis (30) at a first included angle, an annular end-face (38) of said index sub (14) terminating said opposite end in a plane substantially normal to said bent axis (36), a radial portion (50) of said annular end-face being serrated with a regular period, thereby forming index sub serrations;

a mandrel (13) having first pin threads (41) at one distal end turned about a first mandrel axis (40) and second pin threads (43) at an opposite distal end turned about a second mandrel axis 42) and meshed with said first box thread (34), said first (40) and second (41) mandrel axes intersecting at an included angle corresponding to said first angle;

a cylindrical adjusting ring (12) circumferentially disposed about said mandrel (13), a first axis of said ring aligned coincident with said second mandrel axis (42); a first annular endface (64) of said ring in a plane normal to said first ring axis, a second axis of said ring aligned coincident with said first mandrel axis (40) a second annular endface (62) of said ring in a plane that is normal to said second ring axis, said first annular end-face (64) positioned contiguously with said index sub annular end-face (38), thereby forming contiguous annular end faces, a radial portion (70) of said first end-face (64) of said ring being serrated to mesh with said index sub serrations (50);

a linkage mechanism (56/58) between said ring (12) and said mandrel (13) that allows axial translation of said ring along said mandrel parallel with said second mandrel axis (42) and prohibits rotation of said ring about said second mandrel axis (42);

a plurality of bent angle values corresponding to angular intersections of said secondary axis (30) and said first mandrel axis (40), each value representing progressive increments in a bent angle range of 0° and twice the angular degree of said first included angle, said increments progressing by a uniform difference between successive bent angle values, said plurality of bent angle values applied as indicia (54) distributed progressively in opposite arcuate directions on respective outer surfaces of said index sub (14) and said adjusting ring (12) adjacent respectively contiguous annular end-faces (38/64) to adjacently align like indicia values (54) with corresponding intersection angles of said secondary axis (30) and said first mandrel axis (40), a plurality of apertures (52) aligned in an arc in one of said contiguous annular end faces (38/64), the apertures being radially spaced from the serrations, adjacent apertures being separated by an arc angle between correspondingly adjacent indicia; and, a pin projection (74) from the other of said contiguous annular end faces (64) to mesh with said apertures (52).

2. The drilling assembly described by claim 1 further comprising a compression sub having a second box thread meshed with said first mandrel pin threads to secure an angular degree of intersection between said secondary axis and said first mandrel axis.

3. The drilling assembly described by claim 1 wherein said linkage mechanism comprises a plurality of channels in an external surface of said mandrel substantially parallel with said first mandrel axis.

4. The drilling assembly described by claim 3 wherein said linkage mechanism comprises a plurality of channels in an internal surface of said adjusting ring substantially parallel with said first mandrel axis.

5. The drilling assembly described by claim 4 wherein relative rotational displacement between said mandrel and adjusting ring is substantially prevented by one or more balls bridging pairs of radially aligned channels.

6. The drilling assembly described by claim 4 wherein relative rotational displacement between said mandrel and adjusting ring is substantially prevented by one or more rods bridging pairs of radially aligned channels.

7. The drilling assembly described by claim 1 having a first reference position of relative rotation between said index sub and said ring wherein said first mandrel axis is coincident with said secondary axis.

8. The drilling assembly described by claim 7 having a second reference position of relative rotation between said index sub and said ring wherein said first mandrel axis intersects said secondary axis by an included angle that is substantially twice said first included angle.

9. The drilling assembly described by claim 1 wherein the regular period of said end-face serrations is substantially 1.5° arc between adjacent serration apices.

10. The drilling assembly described by claim 9 wherein an angular displacement of said adjusting ring relative to said index sub for a 0.25° indicia differential produces a 0.25° angular intersection change between said first mandrel axis and said secondary axis within ±0.02°.

11. The drilling assembly described by claim 1 wherein rotation of said mandrel second pin threads within said index sub box threads changes the included angle between said index sub secondary axis (30) and said first mandrel axis (40) from 0° to 2° as a function of:

$$Y=3.3\times10^{-10}X^4-2.7\times10^{-7}X^3+2.8\times10^{-6}X^2+0.017X$$

Where:

Y=the acute intersecting angle of the first mandrel axis with the secondary axis and, X=the angular displacement of the adjusting ring relative to said index sub.

12. The drilling assembly described by claim 1 wherein rotation of said mandrel second pin threads within said index sub box threads changes the included angle between said index sub secondary axis and said first mandrel axis from 0° to 3° as a function of:

$$Y=5\times10^{-10}X^4-4\times10^{-7}X^3+4\times10^{-6}X^2+0.0261X$$

Where:

Y=the acute intersecting angle of the first mandrel axis with the secondary axis, and, X=the angular displacement of the adjusting ring relative to said index sub.

13. The drilling assembly described by claim 1 wherein rotation of said mandrel second pin threads within said index sub box threads changes the included angle between said index sub secondary axis (30) and said first mandrel axis (40) from 0° to 4° as a function of:

$$Y=6.5\times10^{-10}X^4-5.4\times10^{-7}X^3+5.4\times10^{-6}X^2+0.035X$$

Where:

Y=the acute intersecting angle of the first mandrel axis (40) with the secondary axis (30), and, X=the angular displacement of the adjusting ring relative to said index sub.

14. A directional drilling assembly comprising:

a substantially cylindrical index sub (14) having box threads (34) at one end turned about a bent axis (36) and pin threads (32) at an opposite end turned about a cylinder (30) axis, said bent axis (36) intersecting cylinder axis (30) at a first included angle, an annular end-face (38) of said index sub terminating said one end in a plane substantially normal to said bent axis (36), a radial portion (50) of said annular end-face (38) having serrations with a regular period of approximately 1.5° arc between serration apices;

a mandrel (13) having first pin threads (41) at one distal end turned about a first mandrel axis (40) and second pin threads (43) at an opposite distal end turned about a second mandrel axis (42), said second pin threads meshed with said index sub box threads (34), said first (41) and second (43) pin threads being separated by a plurality of linking channels (56) in an external surface of said mandrel aligned substantially parallel with said second mandrel axis (42), said first mandrel axis (40) intersecting said second mandrel axis (42) at said first included angle;

a substantially cylindrical adjusting ring (12) disposed about said mandrel having a plurality of linking channels (66) in an internal surface (60) of said adjusting ring aligned substantially parallel with said second mandrel axis (42), a first annular end-face (64) of said ring (12) in a plane substantially normal to said second mandrel axis (42) and a second annular end-face (62) of said ring in a plane substantially normal to said first mandrel axis (40), said first annular end-face (64) positioned adjacent to said index sub (14) annular end-face (38), thereby forming contiguous annular end faces, a radial portion of said first annular end-face (64) being serrated to mesh with said index sub serrations;

bridging elements (58) loosely penetrating radially aligned linking channels (56/66) respective to said mandrel (13) and ring (12) for preventing rotation of said ring (12) relative to said mandrel (13) while permitting axial translation along said mandrel (13) parallel with said second mandrel axis (42);

a plurality of bent angle values corresponding to a plurality of intersection angles of said cylinder axis (30) with said first mandrel axis (40), each value representing progressive increments in a bent angle range of 0° and twice the angular degree of said first included angle, said increments progressing by a uniform difference between successive bent angle values, said plurality of bent angle values applied as indicia (54) distributed progressively in opposite arcuate directions on respective outer surfaces of said index sub (14) and said adjusting ring (12) adjacent respectively contiguous annular end-faces (38/64) to adjacently align like indicia values (54) with corresponding intersecting angles between said cylinder axis (30) and said first mandrel axis (40), a plurality of apertures (52) aligned in an arc in one of said contiguous annular end faces (38/64), the apertures being radially spaced from the serrations, adjacent apertures being separated by an arc angle between correspondingly adjacent indicia; and, a pin projection (74) from the other of said contiguous annular end faces (38/64) to mesh with said apertures (52), one of said plurality of apertures corresponding with a first reference position where said cylinder axis (30) and said second mandrel axis (40) are coaxial.

15. The drilling assembly described by claim 14 having an indicia scale of uniform differential angle increments of 0.25° between said first reference position and a second reference position on each of said index sub and said adjusting ring, said scales advancing in opposite directions from said first reference position of 0° deviation to said second reference position.

16. The drilling assembly described by claim 15 wherein said first mandrel axis (40) intersects said cylinder axis (30) by twice the angular degree of said first included angle at said second reference position.

17. The drilling assembly described by claim 14 having a compression sub (22) with box threads (24) to mesh with said mandrel first pin threads (41) to compressively engage said adjusting ring (12) against said index sub.

18. The drilling assembly described by claim 14 wherein the regular period of said end-face serrations is substantially 1.5° arc between adjacent serration apices.

19. The drilling assembly described by claim 14 wherein an angular displacement of said adjusting ring relative to said index sub for a 0.25° indicia differential produces a 0.25° angular intersection change between said first mandrel axis and said cylinder axis within ±0.02°.

20. The drilling assembly described by claim 14 wherein rotation of said mandrel second pin threads (43) within said index sub box threads (34) changes the included angle between said index sub cylinder axis (30) and said first mandrel axis (40) from 0° to 2° as a function of:

$$Y=3.3\times10^{-10}X^4-2.7\times10^{-7}X^3+2.8\times10^{-6}X^2+0.017X$$

Where:

Y=the acute intersecting angle of the first mandrel axis (40) with the cylinder axis (30) and, X=the angular displacement of the adjusting ring relative to said index sub.

21. The drilling assembly described by claim 14 wherein rotation of said mandrel second pin threads (43) within said index sub box threads (34) changes the included angle between said index sub cylinder axis (30) and said first mandrel axis (40) from 0° to 3° as a function of $$Y=5\times10^{-10}X^4-4\times10^{-7}X^3+4\times10^{-6}X^2+0.0261X$$

Where:

Y=the acute Intersecting angle of the first mandrel axis (40) with the cylinder axis (30) and, X=the angular displacement of adjusting ring relative to the index sub.

22. The drilling assembly described by claim 14 wherein rotation of said mandrel second pin threads (43) within said index sub box threads (34) changes the included angle between said index sub cylinder axis (30) and said first mandrel axis (40) from 0° to 4° as a function of:

$$Y=6.5\times10^{-10}X^4-5.4\times10^{-7}X^3+5.4\times10^{-6}X^2+0.035X$$

Where:

Y=the acute intersecting angle of the first mandrel axis (40) with the cylinder axis (30) and, X=the angular displacement of the adjusting ring relative to said index sub.

23. A directional drilling apparatus comprising:

a substantially cylindrical index sub (14) having an index axis (30) and an internal bore; first box threads (34) within said internal bore at one end of said index sub (14) being turned about a bent axis (36), said bent axis (36) intersecting said index axis (30) at a first included angle; an annular end-face (38) of said index sub (14) terminating said one end in a plane substantially normal to said bent axis (36); index sub serrations (50) being provided in a radial portion of said annular end-face (38), the serrations being separated by regular increments:

a substantially cylindrical mandrel (13) having first pin threads (41) at one mandrel end turned about a first mandrel axis (40) and second pin threads (43) at an opposite end of said mandrel (13) turned about a second mandrel axis (42) and meshed with said first box threads; said first (40) and second (42) mandrel axes intersecting at an included angle substantially corresponding to said first included angle:

a substantially cylindrical adjusting ring (12) disposed about said mandrel (13); said adjusting ring (12) having a rotation prevention mechanism (58) linking said adjusting ring (12) to said mandrel (13) for restraining said ring from rotation about said mandrel while permitting limited axial translation of said adjusting ring along said mandrel parallel with said second mandrel axis (42); a first annular end-face (64) of said ring formed in a plane intersected at said first included angle by said first mandrel axis (40); a second annular end-face (62) of said adjusting ring formed in a plane normal to said first mandrel axis (40); a radial portion (70) of said first annular end-face (64) being serrated to mesh with said index sub serrations (50), the annular end face and the first annular end face forming contiguous annular end-faces;

a compression sub (22) having a second box thread (24) turned about a normal cylinder axis (28) and meshed with said first mandrel pin threads (41) to secure an angular position of said adjusting ring (12) relative to said index sub (14) by compressing said adjusting ring (12) first annular end-face (64) against said index sub (14) annular end-face (38);

a plurality of bent angle values corresponding to angular intersections of said index axis (30) and said first mandrel axis (40), each value representing progressive increments in a bent angle range of 0° and twice the angular degree of said first included angle, said increments progressing by a uniform bent angle difference between successive bent angle values, said plurality of bent angle values applied as indicia (54) distributed progressively in opposite arcuate directions on respective outer surfaces of said index sub (14) and said adjusting ring (12) adjacent respectively contiguous annular end-faces (38/64) to adjacently align like indicia (54) values with corresponding bent angle values;

a plurality of apertures (52) aligned in an arc in one of said contiguous annular end faces (38/64), the apertures being radially spaced from the serrations, adjacent apertures being separated by an arc angle between correspondingly adjacent indicia; and, a pin projection (74) from the other of said contiguous annular end faces to mesh with said apertures (52), one of said plurality of apertures corresponding with a first reference position where said index axis (30) and said first mandrel axis (40) are coaxial.

24. The drilling assembly described by claim 23 wherein said indicia values comprise a scale of successive bent angle values separated by substantially equal differences between said first reference position and a second reference position on each of said index sub and said adjusting ring, said indicia values advanced in opposite directions.

25. The drilling assembly described by claim 23 wherein said rotation prevention mechanism comprises a plurality of channels (56) about an external surface of said mandrel between said first and second pin threads in paired radial alignment with channels (66) in an internal bore wall (60) of said adjusting ring.

26. The drilling assembly described by claim 25 wherein relative angular displacement between said mandrel and said adjusting ring is substantially prevented by one or more balls bridging respective pairs of radially aligned channels.

27. The drilling assembly described by claim 25 wherein relative angular displacement between said mandrel and said adjusting ring is substantially prevented by one or more rods bridging said pairs of radially aligned channels.

28. The drilling assembly described by claim 23 wherein the regular period of said end-face serration is substantially 1.5° arc between adjacent serration apices.

29. The drilling assembly described by claim 23 wherein an angular displacement of said adjusting ring relative to said index sub for a 0.25° indicia differential produces a 0.25° angular intersection change between said first mandrel axis and said index axis within ±0.02°.

30. The drilling assembly described by claim 23 wherein rotation of said mandrel second pin threads (43) within said index sub box threads (34) changes the included angle between said index axis (30) and said first mandrel axis (40) from 0° to 2° as a function of $$Y=3.3\times10^{-10}X^4-2.7\times10^{-7}X^3+2.8\times10^{-6}X^2+0.017X$$

Where:

Y=the acute intersecting angle of the first mandrel axis (40) with the index axis (30) and, X=the angular displacement of the adjusting ring relative to said index sub.

31. The drilling assembly described by claim 23 wherein rotation of said mandrel second pin threads (43) within said index sub box threads (34) changes the included angle between said index axis (30) and said first mandrel axis (40) from 0° to 3° as a function of $$Y=4.9\times10^{-10}X^4-4.0\times10^{-7}X^3+4.0\times10^{-6}X^2+0.026X$$

Where:

Y=the acute intersecting angle of the first mandrel axis (40) with the index axis (30) and, X=the angular displacement of the adjusting ring relative to said index sub.

32. The drilling assembly described by claim 23 wherein rotation of said mandrel second pin threads (43) within said index sub box threads (34) changes the included angle between said index axis (30) and said first mandrel axis (40) from 0° to 4° as a function of $$Y=6.5\times10^{-10}X^4-5.4\times10^{-7}X^3+5.4\times10^{-6}X^2+0.035X$$

Where:

Y=the acute intersecting angle of the first mandrel axis (40) with the index axis (30) and, X=the angular displacement of the adjusting ring relative to said index sub.

* * * * *